United States Patent [19]

Ohashi et al.

[11] Patent Number: 5,074,195

[45] Date of Patent: Dec. 24, 1991

[54] FIXED SWASH PLATE FOR AN AXIAL PISTON MACHINE

[75] Inventors: Ryota Ohashi, Kobe; Kenichi Takada, Amagasaki, both of Japan

[73] Assignee: Kanzaki Kokyukoki Mfg. Co., Ltd., Amagasaki, Japan

[21] Appl. No.: 623,772

[22] Filed: Dec. 7, 1990

[30] Foreign Application Priority Data

Dec. 13, 1989 [JP] Japan ..... 1-143670[U]

[51] Int. Cl.[5] ..... F01B 13/04; F01B 29/04

[52] U.S. Cl. ..... 92/57; 92/59; 92/71; 91/505; 60/458; 417/239

[58] Field of Search ..... 91/505, 506; 92/12.2, 92/57, 59, 70, 71, 128; 417/239; 60/458

[56] References Cited

U.S. PATENT DOCUMENTS

| | | | |
|---|---|---|---|
| 3,375,756 | 4/1968 | Bienaime | 91/506 |
| 4,611,529 | 9/1986 | Stricker et al. | 92/128 X |
| 4,891,943 | 1/1990 | Okada | 60/464 |
| 4,903,545 | 2/1990 | Louis et al. . | |
| 4,932,209 | 6/1990 | Okada et al. | 91/505 X |
| 4,953,426 | 9/1990 | Johnson | 60/487 X |

*Primary Examiner*—Edward K. Look
*Assistant Examiner*—John Ryznic
*Attorney, Agent, or Firm*—Sterne, Kessler, Goldstein & Fox

[57] ABSTRACT

A fixed swash plate for an axial piston machine of fixed capacitive type, which has a casing housing therein a cylinder, is formed to have its divided surfaces on the horizontal plane along the axis of the rotary shaft of the cylinder, wherein a support member constituting a fixed swash plate is formed to be easy to produce and the casings merely sandwich therebetween the support member, whereby a thrust bearing constituting the fixed swash plate is held in the state of being slanted at a predetermined angle other than 90° with respect to the axis of rotary shaft. Also, the rotation direction of the fixed capacitive type axial piston machine is easy to change by inverting at an angle of 180° the assembling direction of support member constituting the fixed swash plate.

3 Claims, 6 Drawing Sheets

FIXED SWASH PLATE FOR AN AXIAL PISTON MACHINE

FIELD OF THE INVENTION

The present invention relates to mounting a fixed swash plate to a fixed capacitive type axial piston machine, such as a hydraulic motor, of HST (hydrostatic transmission) system speed change apparatus.

RELATED ART

The fixed capacitive type axial piston machine, such as a hydraulic motor, is so constructed that pistons, each biased by a spring, are disposed around a motor shaft. The head of each piston abuts against a thrust bearing at a fixed swash plate fixed to a transmission casing, which is disclosed in, for example, U.S. Pat. No. 4,891,943.

In the above-mentioned reference, in order to hold the thrust bearing in the slanted state at a fixed angle, a support member separate from the casing is used, which support member is divided into a part holding the thrust bearing and that held by the casing.

However, the support member, which is cylindrical as a whole and larger in size, deteriorates its accuracy for being cast-molded without machining.

Also, positioning means for fixing the support member to the casing is required to fix the thrust bearing in the state where the thrust bearing is slanted at a predetermined angle other than 90° with respect to the axis of a rotary shaft, but the reference does not include such means.

Only the support member to hold the thrust bearing not through the casing is subjected to oil pressure from pistons, whereby the durability of the support member is problematical.

Since a bearing for supporting the rotary shaft is held at a portion held by the casing, if shifting occurs during the coupling of both the casings, there is the inconvenience that the support member is inclined in the casing.

SUMMARY OF THE INVENTION

A first object of the present invention is to provide a fixed swash plate on an axial piston machine which has a casing for housing therein cylinders for a fixed capacitive axial piston machine, such as a hydraulic motor, and divided to have the surfaces on the horizontal plane along the axis of rotary shaft of the cylinder, the swash plate being so constructed that a support member constituting the fixed swash plate is made simple in configuration to be easy to produce and the divided casings merely sandwich therebetween the support member, whereby the thrust bearing, another member for constituting the fixed swash plate, is held to the casing.

On the other hand, in the fixed capacitive type axial piston machine, a movable swash plate at the variable capacitive type hydraulic pump, when rotated by a control lever in one direction from the neutral position, normally rotates and, when rotated in the other direction, reversely rotates, in which a driven member driven by the hydraulic motor, even when a movable swash plate at the hydraulic pump side rotates in the same direction as the above, may be required to rotate reversely to the rotation direction of hydraulic motor. In order to meet such requirement, conventionally, means has been used which interposes an intermediate link between the control lever and the movable swash plate in order to reversely convert the operating direction, in which there is the inconvenience that new parts are added or the number of assembly processes increases.

Therefore, a second object of the present invention is to provide a fixed swash plate which can reversely rotate only by changing the orientation of the support member constituting the same at the hydraulic motor side.

These and other objects of the invention will become more apparent in the detailed description and examples which follow.

DESCRIPTION OF THE PREFERRED EMBODIMENTS

Figure 1:
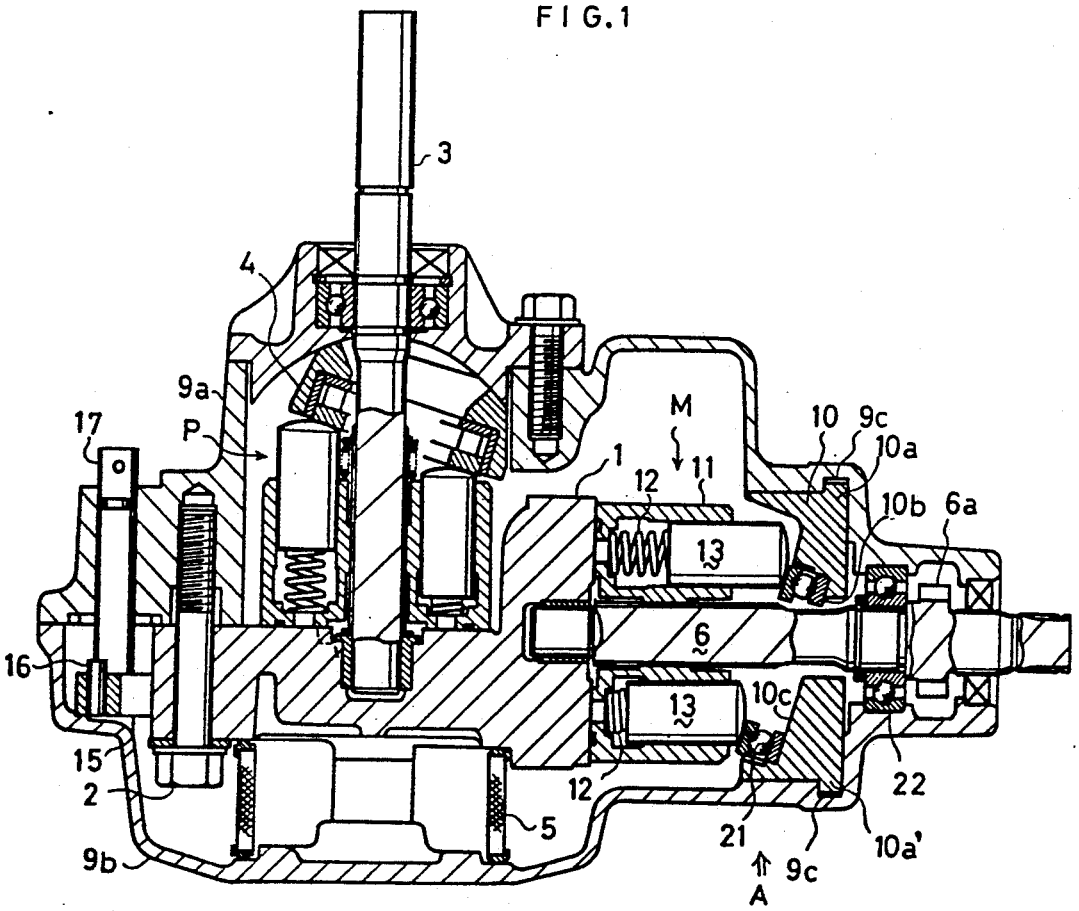
FIG. 1 is a sectional front view of an axle driving apparatus.

FIG. 1 is a sectional front view of an axle driving apparatus, in which a casing 9 has its divided surface on the horizontal plane along the axis of a rotary shaft of a cylinder 11 at the hydraulic motor side. The casing 9 is formed of upper and lower half divided casings **9*a* and 9*b*, in which are disposed a hydraulic pump P and the hydraulic motor M of an HST system transmission. A cylinder of the hydraulic pump P and the cylinder 11 of hydraulic motor M are rotatably provided at the upper surface of a horizontal portion and the side surface of a vertical portion of a center section 1**.

The center section 1 comprises the horizontal portion and vertical portion in continuation thereof, and is about L-like-shaped when viewed from the front and fixed to the upper casing **9*a* by bolts 2, the lower casing 9*b* being coupled with the upper casing 9*a* so that the center section 1 is disposed in the casing 9**.

A pump shaft 3 is erected at the center of the upper surface of center section 1, and perforates the upper casing **9*a* and projects upwardly, and fixes a pulley at the exterior of a transmission casing 9**, thereby obtaining power from an engine.

A cylinder of hydraulic pump P is integrally fitted onto the pump shaft 3, a movable swash plate 4 is rotatably disposed along the inner wall of the upper casing 9, and a plurality of piston heads projecting from the cylinder abut against a thrust bearing provided at the movable swash plate 4.

The angle of movable swash plate 4 is constructed to be changeable by an external lever which changes the discharge direction and volume of pressure oil from the hydraulic pump P.

Figure 2:
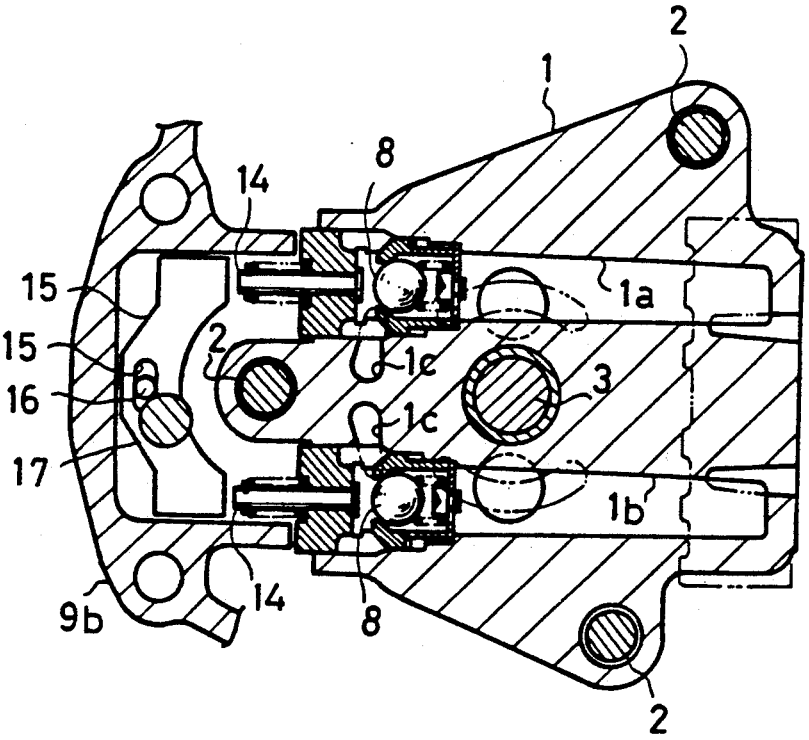
FIG. 2 is a sectional plan view of a center section thereof.

Within the center section 1, as shown in FIG. 2, are perforate oil passages **1*a* and 1*b*** for circulating operating oil between the hydraulic pump P and the hydraulic motor M and constituting a closed circuit.

In order to supply the operating oil to the closed circuit, check valves 8 and push levers 14 are provided at the opening sides of horizontally perforating oil passages 1*a* and 1*b*.

An annular filter 5 is disposed at the lower surface of center section 1, and oil passages 1*c* are provided which downwardly perforate from the inlets of both the check valves 8.

In addition, the ends of push levers 14 are contactable with a slider 15 provided in the transmission casing 9, an elongated slot 15*a* opens at the center of the slider 15, a pin 16 is inserted into the slot 15*a* and fixed to a rotary shaft 17 vertically provided at the upper casing 9*a*, and the rotary shaft 17 is rotatable by an external neutral lever.

Therefore, when the neutral lever is rotated for hauling a tractor equipped with the HST transmission of the present invention, the slider 15 advances to push the push levers 14 to forcibly open the check valves 8, and the operating oil at the discharge side and the inflow side communicates with the interior of transmission casing 9 through the oil passages 1*c*, so that the hydraulic motor M is freely rotatable.

Figure 3:
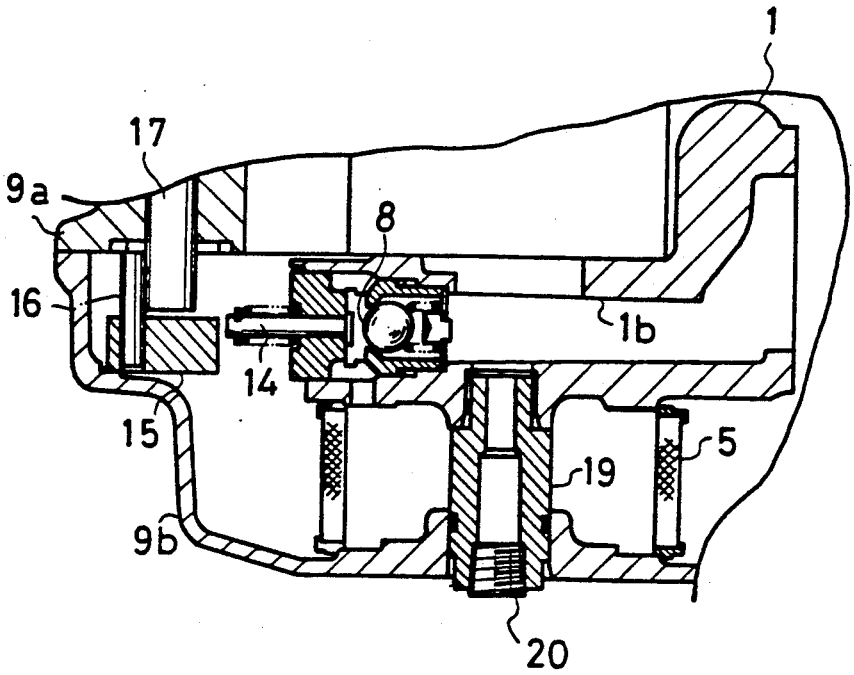
FIG. 3 is a sectional front view of a check valve in the same.

Between the center section 1 and the lower casing 9*b* is interposed the annular filter 5, in which, as shown in FIG. 3, pipe bodies 19 are provided and perforate the lower casing 9*b* to thereby communicate the oil passages 1*a* and 1*b* with the exterior.

When assembly of the axle driving apparatus is completed, the pipe bodies 19 are provided to use operating oil for exhausting air from the closed circuit at the HST system speed change apparatus. When oil filling ends, a plug 20 is put to make the HST system speed change apparatus operable.

A rotary shaft 6 supported by a vertical portion of center section 1 is horizontally provided between the contact surfaces of the upper casing 9*a* and lower casing 9*b* and rotatably supported by the same through a bearing 22 held across both the casings 9*a* and 9*b*.

On the rotary shaft 6 is disposed a cylinder 1 of the hydraulic motor M.

At the hydraulic motor M, pistons 13 with springs 12 are provided around the axis of rotary shaft 6, the springs 12 and pistons 13 being housed in the cylinder 11. The head of each piston 13 abuts against a thrust bearing 21 fitted into a support member 10.

A fixed swash plate A comprises the thrust bearing 21 and support member 10 for fixing the thrust bearing 21 in the state of being slanted at a predetermined angle other than 90° with respect to the rotary shaft 6.

Figure 4:
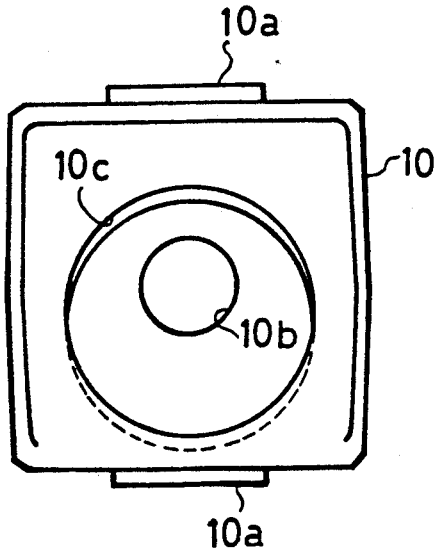
FIG. 4 is a front view of a fixed swash plate.

The support member 10, as shown in FIG. 4, is square in external configuration. In this embodiment, the lateral side surfaces of the support member 10 are slanted so as to be easy to extract from a mold.

Figure 5:
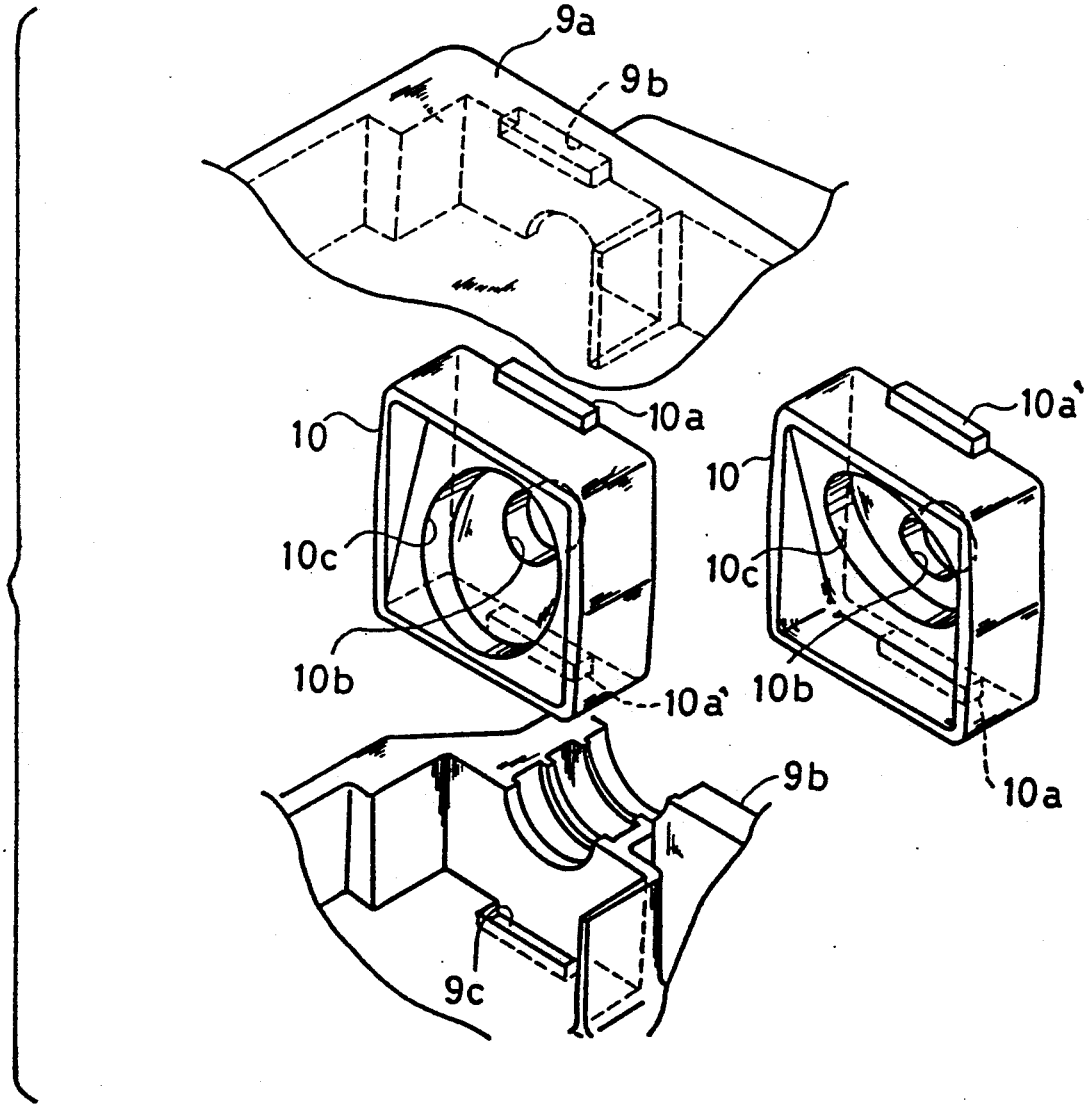
FIG. 5 is a perspective exploded view of the fixed swash plate.

The support member 10, as shown in FIGS. 4 and 5, is cast without machining and formed in the exterior to be vertically and horizontally symmetrical on the basis of the axis of rotary shaft 6: the motor axis. A shaft bore 10*b* into which the rotary shaft 6 of motor shaft is inserted is open at the center of support member 10, and a recess 10*c* is formed into which the thrust bearing 21 is inserted in the state of being slanted at a predetermined angle other than 90° with respect to the axis of rotary shaft 6.

The slanting direction of recess 10*c*, that is, the slanting direction of thrust bearing 21, depends on facing of a kidney port open at the center section 1. Since the facing of the kidney port can variously be positioned around the rotary shaft 6 and in a range of 360° corresponding to the design of the port, the slanting direction of thrust bearing 21 can be decided corresponding to various positions around the rotary shaft 6 in a range of 360°.

The present invention keeps the configuration of casing 9 as it is and the recess 10*c* is formed to change the slanting direction thereof, thereby simply meeting such requirement.

Figure 7:
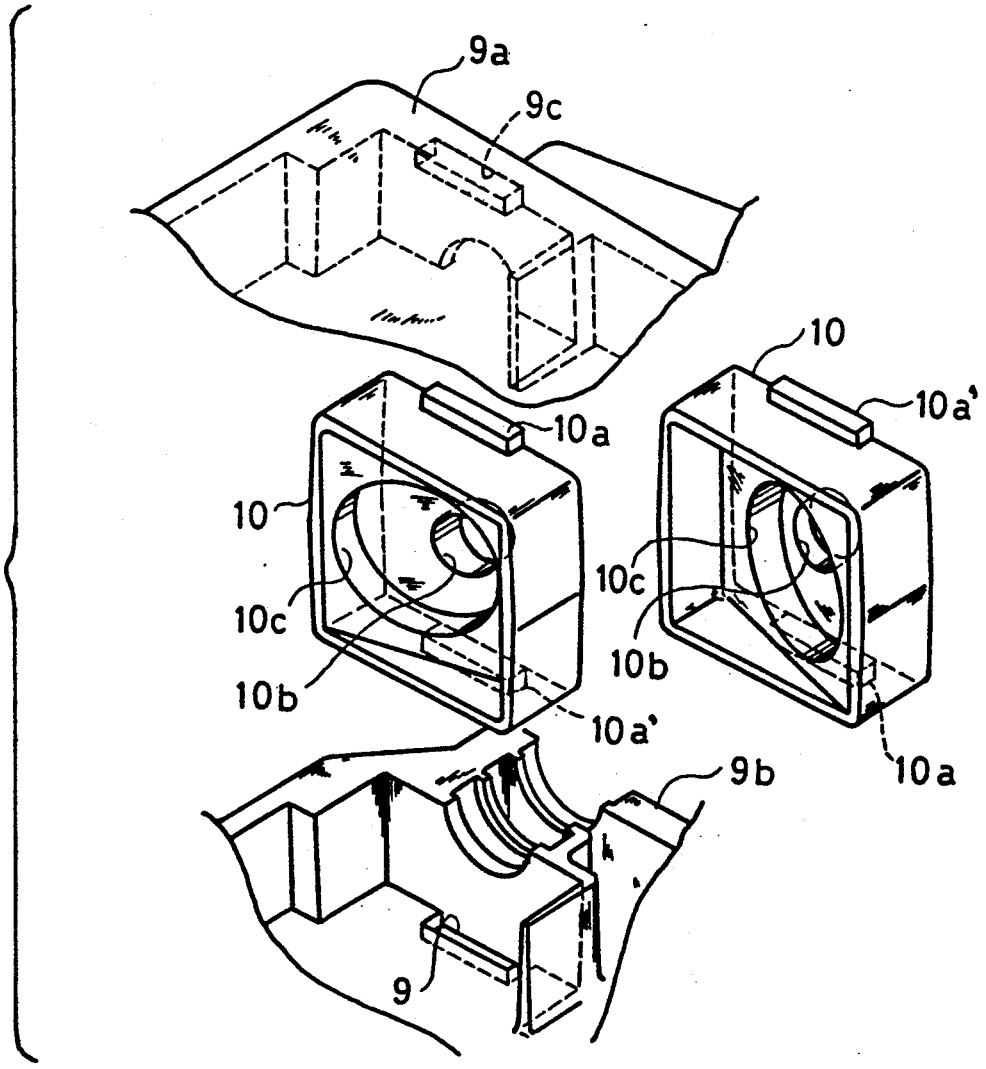
FIG. 7 is a perspective exploded view of a modified embodiment of the fixed swash plate of the invention, showing a support member thereof.

The support member 10 in which the slanting direction of recess 10*c* is displaced at 90° from that in FIG. 5 is shown in FIG. 7.

The upper casing 9*a* and lower casing 9*b* are provided with recesses into which an upper half and a lower half of the support member 10 are fitted respectively, the fitting recess being formed to be interposed between the cylinder 11 and the bearing 22. The support member 10 holding the thrust bearing 21 is fitted into the fitting recesses and both the casings 9*a* and 9*b* are coupled with each other to interpose therebetween the support member 10.

When the square-shaped support member 10 abuts against the fitting recesses in the casing 9, the rotation direction and the vertical movement of support member 10 are restricted within the casing 9, thereby fixing the slanting direction of thrust bearing 21 in the position as designed.

Also, when the cylinder 11 rotates, a force radially acting on the thrust bearing 21 from the piston 13 is received at the horizontal walls of the fitting recesses of the casings 9*a* and 9*b* abutting against the peripheral upper surface and peripheral lower surface of the support member 10. A force acting in the thrust direction is received by the vertical walls of casings 9*a* and 9*b* abutting against the rear surface of support member 10.

A projection 10*a* is integrally formed at an optional position at the outer periphery of support member 10 and a recess 9*c* into which the projection 10*a* is to be fitted is provided at the casing 9, which is used as a positioning means for restricting the axial movement of fixed swash plate A with respect to the casing 9.

The projection comprises a pair of projections 10*a* and 10*a*′ so that the support member 10 may be assembled vertically reversely, the projections 10*a* and 10*a*′ being formed in the vertically and horizontally symmetrical positions from the shaft bore 10*b* at the center of support member 10 and similar in configuration when viewed from the front and the lateral side. When viewed from the lateral side, the projections 10*a* and 10*a*′ of the support member 10 are formed at the rear surfaces to be in continuation of the rear surface of support member 10 in the same plane.

At the fitting recesses of casings 9*a* and 9*b* are provided fitting recesses 9*c* into which the projections 10*a* and 10*a*′ of the support member 10 are fitted not to create a shift thereof.

In addition, in the embodiment in FIGS. 4, 5, 6 and 7, the projections 10*a* and 10*a*′ are provided at the upper periphery and lower periphery of support member 10. Alternatively, the projections 10*a* and 10*a*′ may be provided at the lateral surfaces and fitting recesses 9*c* corresponding to the projections 10*a* and 10*a*′ may be formed at the coupling surfaces of divided casings 9*a* and 9*b*.

Figure 6:
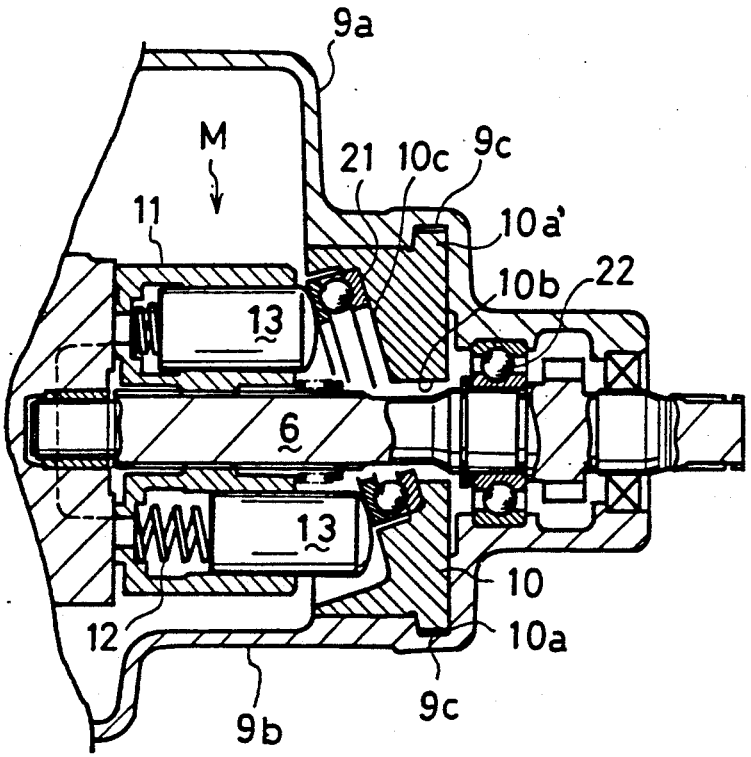
FIG. 6 is a partially sectional front view thereof in the state of being vertically reversely assembled.

In such construction, when the bearing 21 is fitted into the recess 10*c* and the support member 10 is built in between the upper casing 9*a* and the lower casing 9*b*, as shown in FIGS. 1 and 5, the rotary shaft 6 rotates in the forward direction. When vertically reversely assembled, as shown in FIG. 6, the rotary shaft 6 reversely rotates.

As immediately understood from FIGS. 5 and 7, the casings 9*a* and 9*b* are similar and two support members 10, whose recesses 10*c* are displaced at an angle of 90° in the slanting direction, are prepared, so that the members 10 are re-assembled to enable the thrust bearing 21 in four different slanting directions to be set in the casing 9.

Upon feeding pressure oil from the hydraulic pump P to the cylinder 11 of hydraulic motor M, the pistons 13 project in a sliding manner in the slanting direction of thrust bearing 21, whereby the cylinder 11 starts rotation. Power is transmitted from a gear 6*a* threaded on the intermediate portion of rotary shaft 6: motor shaft, to a differential device through reduction gears (not shown) disposed in the transmission casing 9, thereby driving the axle.

The present invention constructed as above-mentioned has the following advantages.

The thrust bearing 21 at the fixed swash plate A is held in the state of slanting at a predetermined angle through the support member 10 separate from the casing 9, the inner wall thereof need only be simply machined to meet with the square shape of support member 10, thereby enabling the machining cost of casing 9 to be reduced.

Since the support member 10 of the fixed swash plate A is a single body and is provided at a portion held by the casing with the recess 10*c* for holding the thrust bearing 21, its configuration is compact and smaller in width, whereby machining is not difficult and cast-molding is performable without any machining.

The position of thrust bearing 21 corresponds to the position of kidney port open at the center section 1, so that the thrust bearing 21 can be slanted in various directions. In the present invention the casing 9 is not required to be machined and the support member 10 is machined only to change the slanting direction of the recess 10*c* therein to thereby simply cope with the requirement, thus largely improving the degree of freedom in design.

The support member 10 is completely built in only by coupling both the casings 9*a* and 9*b* with each other and reliably fixed to prevent shifts in the slanting direction of thrust bearing 21, whereby there is no need for additional fastening means such as bolts to fix the slanting direction of thrust bearing 21, and extremely simple work is enough to assemble the apparatus.

Oil pressure acting on the pistons 13 and thrust bearing 21 in the radial and thrust directions is uniformly dispersed to the casings 9*a* and 9*b* through the support member 10 and stably received by the casing 9, thereby improving durability of casing 9 or support member 10.

Since the bearing 22 restrains a shift in the direction of dividing line for the casings 9*a* and 9*b*, the support member 10 is not slanted and accurately held in the casing 9.

The positioning means can be provided simultaneously with molding the support member 10 and casing 9 and the projections 10*a* and 10*a'* of support member 10 are fitted into the recesses 9*c* at the casing 9 and both the casings 9*a* and 9*b* merely are coupled, so that the fixedly assembly and axial positioning of support member 10 are simultaneously performed, thereby not requiring any special work.

Conventionally, in order to present the rotation direction required by a driven member, a movable swash plate of an axial piston machine of variable capacitive type is changed in its rotation direction by interposing an intermediate link in its operation system or by interposing an intermediate transmitting member between the rotary shaft and the driven member, thereby coping with the requirement. However, in the present invention, the projections 10*a* and 10*a'* at the support member 10 for positioning it are provided symmetrically with respect to the axis of rotary shaft 6 of motor shaft, so that the mounting positions of projections 10*a* and 10*a'* with respect to the casing 9 are selectively alternated, thereby enabling the slanting direction of thrust bearing 21 to be inverted at an angle of 180° around the axis of rotary shaft 6. Hence, when the rotation direction of rotary shaft 6 does not coincide with that required by the driven member, the support member 10 is inverted at an angle of 180° from the present position to be mounted to the casing 9, thereby enabling the rotary shaft 6 to reversely rotate.

Therefore, the rotation direction of rotary shaft 6 of motor shaft can coincide with that required by the driven member without adding new parts, but only by changing the mounting position of support member 10.

What is claimed is:

1. A fixed swash plate for an axial piston machine, comprising:

a. a cylinder holding a plurality of pistons being disposed on a rotation surface of a center section fixed in a casing;

b. said casing having divided surfaces thereof disposed in a horizontal plane along an axis of a rotary shaft of said cylinder;

c. said rotary shaft being integrally rotatable with said cylinder, and rotatably supported by a bearing in said casing and said center section;

d. a fixed swash plate being disposed between said cylinder and said bearing;

e. said fixed swash plate comprising a support member and a thrust bearing;

f. said support member being substantially square-shaped and perforated with a shaft bore through which said rotary shaft is inserted, and provided with a recess for holding therein said thrust bearing such that it is slanted at a predetermined angle other than 90° with respect to the axis of said rotary shaft;

g. said support member being sandwiched between said divided surfaces of said casing so as to fix the slanting direction of said thrust bearing; and h. positioning means for restraining axial movement of said support member.

2. A swash plate for an axial piston machine according to claim 1, wherein a projection is integrally provided at the outer periphery of said support member, and a recess is provided in said casing, into which said projection can be inserted, thereby constituting said positioning means.

3. A fixed swash plate for an axial piston machine, comprising:

a. a cylinder holding a plurality of pistons and being disposed on a rotation surface of a center section fixed to a casing;

b. a rotary shaft integrally rotatable with said cylinder and being rotatably supported by said casing and said center section;

c. a fixed swash plate comprising a support member and a thrust bearing abutting against said pistons;

d. said support member being perforated with a shaft bore through which said rotary shaft is inserted, and provided with a recess for holding therein said thrust bearing such that it is slanted at a predetermined angle other than 90° with respect to the axis of said rotary shaft, and provided at symmetrical positions to the axis of said rotary shaft with a pair of projections for positioning said support member with respect to said casing; and e. said support member being positioned in said casing by selectively alternating the mounting positions of said projections, whereby the slanting direction of said thrust bearing can be inverted at an angle of 180° around the axis of said rotary shaft.

* * * * *